US011350662B1

(12) United States Patent
Bavar et al.

(10) Patent No.: US 11,350,662 B1
(45) Date of Patent: Jun. 7, 2022

(54) HOOKAH DOWNSTEM FILTER ASSEMBLY

(71) Applicant: Kaloud, Inc., Los Angeles, CA (US)

(72) Inventors: Reza Bavar, Los Angeles, CA (US); Skyler Olsen, Denver, CO (US)

(73) Assignee: Kaloud, Inc., Los Angeles, CA (US)

( * ) Notice: Subject to any disclaimer, the term of this patent is extended or adjusted under 35 U.S.C. 154(b) by 0 days.

(21) Appl. No.: 17/519,306

(22) Filed: Nov. 4, 2021

Related U.S. Application Data

(63) Continuation of application No. PCT/US2020/065296, filed on Dec. 16, 2020.

(51) Int. Cl.
*A24F 1/30* (2006.01)
*A24D 3/06* (2006.01)
*A24D 3/16* (2006.01)

(52) U.S. Cl.
CPC ..... *A24F 1/30* (2013.01); *A24D 3/062* (2013.01); *A24D 3/163* (2013.01)

(58) Field of Classification Search
None
See application file for complete search history.

(56) References Cited

U.S. PATENT DOCUMENTS 1,917,121 A * 7/1933 Hughson ..... B01D 35/04 210/94
10,034,491 B1 7/2018 Bavar et al.
2015/0351452 A1 12/2015 Monazzah et al.

FOREIGN PATENT DOCUMENTS

FR 3048588 A1 9/2017
RU 2430664 C2 10/2011

OTHER PUBLICATIONS

International Search Report with Written Opinion issued for corresponding International Patent Application No. PCT/US2020/065296 dated Mar. 4, 2021.

* cited by examiner

*Primary Examiner* — Dennis R Cordray
(74) *Attorney, Agent, or Firm* — Myers Wolin, LLC

(57) ABSTRACT

A filter assembly has an outer housing having an open first end and an open second end. An inner filter housing is within the outer housing adjacent the second end, and a gasket is provided at the first end of the outer housing. An internal chamber is provided between the first end of the outer housing and the inner filter housing, where during use, fluid from the within the internal chamber is drawn out the second end of the outer housing by way of the inner filter housing. A filter is provided within the inner filter housing. The gasket forms a gasketed opening smaller than the open first end of the outer housing. The gasket may extend axially adjacent a wall of the outer housing and abut the inner filter housing, such that the internal chamber is defined by the gasket and the inner filter housing.

16 Claims, 10 Drawing Sheets

HOOKAH DOWNSTEM FILTER ASSEMBLY

CROSS REFERENCE TO RELATED APPLICATIONS

This application is a continuation under 35 U.S.C. § 120 of International Application PCT/US2020/065296, filed Dec. 16, 2020, the contents of which are incorporated by reference herein.

FIELD OF THE INVENTION

The subject matter described herein relates generally to a systems, devices, and methods for smoking tobacco or other organic material using a water pipe.

BACKGROUND

Existing and traditional water pipes, known as hookahs, generally include a plate for supporting charcoal, a head for containing tobacco, a body including an internal pipe, known as a downstem, a base for containing water, and a hose. Typically, a user will first fill the base with water and then fix the body to the base such that the body creates an airtight seal with the base and such that the downstem extends into the water.

The head is then filled with tobacco, or other organic material, and placed over the internal pipe such that an airtight seal is created between the internal pipe and the head. Next the user places the plate over the head, places one or more lit charcoals on the plate and these charcoals serve to heat the tobacco, or other organic material, underneath the plate. The hose is typically attached to the body such that it has an airtight connection with air above the water in the base. The user can inhale through the hose, which draws smoke from the heated tobacco, or other organic material, in the head through the internal pipe, through the water contained in the base, through the hose and into the user's lungs.

While standard water pipes are known, the embodiments provided herein teach features and advantages heretofore untaught by the prior art, as will be clear to one of ordinary skill in the art.

SUMMARY

In some embodiments, a filter assembly is provided, the filter assembly comprising an outer housing having an open first end and an open second end. An inner filter housing is provided within the outer housing adjacent the second end, and a gasket is provided at the first end of the outer housing. An internal chamber is provided between the first end of the outer housing and the inner filter housing, where during use, fluid from the within the internal chamber is drawn out the second end of the outer housing by way of the inner filter housing.

Typically, a filter is provided within the inner filter housing. Such a filter may be a carbon filter, and it may comprise a carbon sponge located adjacent carbon pellets. As such, fluid filtered by the filter passes through the carbon sponge and the carbon pellets consecutively.

The gasket at the first end of the outer housing forms a gasketed opening smaller than the open first end at the open first end of the outer housing. The gasket may then extend axially adjacent a wall of the outer housing and abut the inner filter housing, such that the internal chamber is defined by the gasket and the inner filter housing. In such embodiments, the outer housing may be substantially cylindrical, and the outer housing may be internally lined by the gasket. The inner filter housing may be at least partially conical, such that an axial end of the gasket may abut a conical surface of the inner filter housing.

During use, the internal chamber within the outer housing encloses an end of a hookah downstem such that fluid drawn from the downstem is drawn through the inner filter housing. In some embodiments, the filter assembly further comprises an aerator at the second end of the housing.

In some embodiments, a method is provided for filtering fluid in a hookah. Such a method comprises providing an outer housing having an open first end and an open second end, locating an inner filter housing within the Souter housing adjacent the second end, such that an internal chamber is formed between the first end of the outer housing and the inner filter housing, and locating a gasket as the open first end of the outer housing. The gasket may then form a gasketed opening smaller than the open first end of the outer housing.

The method further comprises sliding the gasketed opening onto an end of a hookah downstem to form a fluid tight connection between the gasket and the downstem, locating the end of the hookah downstem within the outer housing, and drawing fluid from the second end of the outer housing. Fluid drawn from the second end of the outer housing is then received from the downstem by way of the inner filter housing.

The inner filter housing typically is provided with a filter within the housing, such that fluid passing through the inner filter housing is filtered by the filter. The filter may be a carbon filter, which may comprise a carbon sponge located adjacent carbon pellets, such that fluid filtered by the filter passes through the carbon sponge and the carbon pellets consecutively.

Other features and advantages of the present invention will become apparent from the following more detailed description, taken in conjunction with the accompanying drawings, which illustrate, by way of example, the principles of the present invention.

DETAILED DESCRIPTION OF THE PREFERRED EMBODIMENTS

Figure 1:
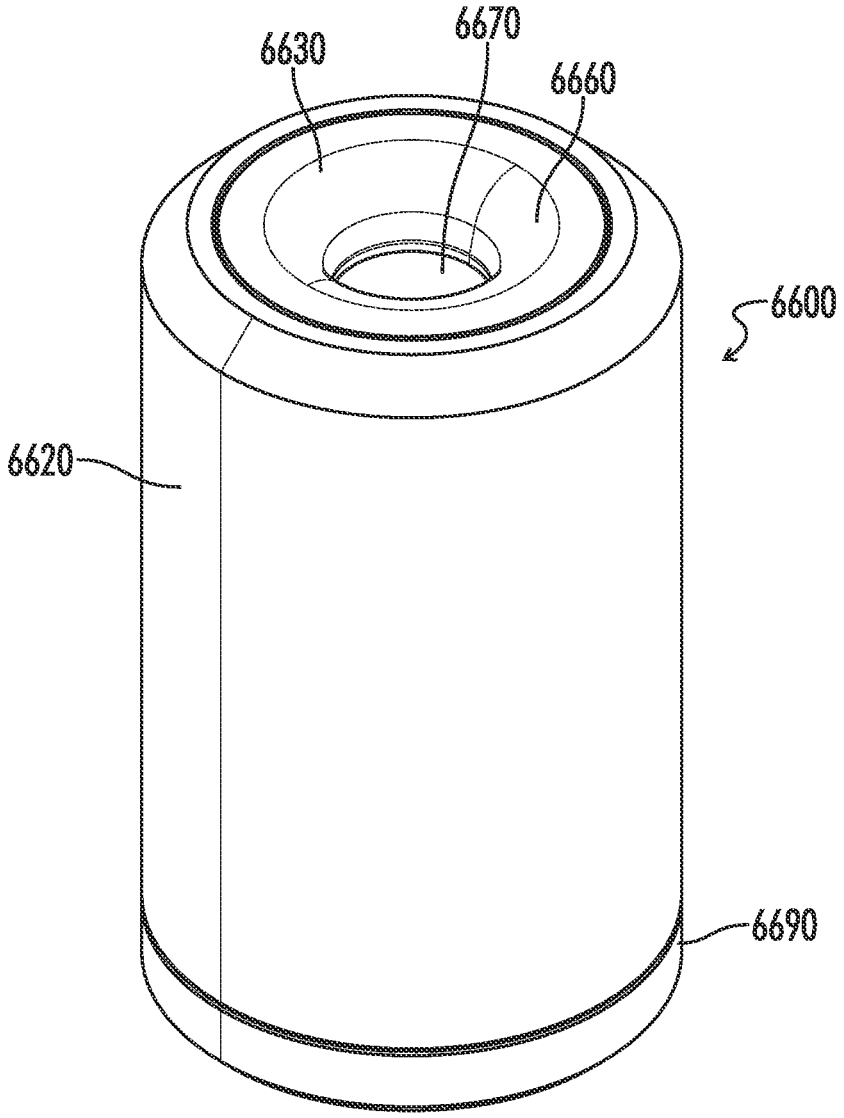
FIG. 1 is a filter assembly in accordance with this disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
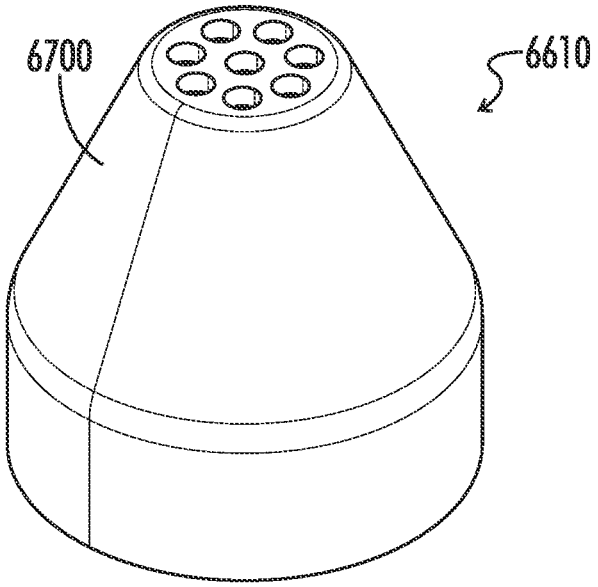
FIG. 2 is an inner filter housing for use in the filter assembly of FIG. 1.
Figure 3:
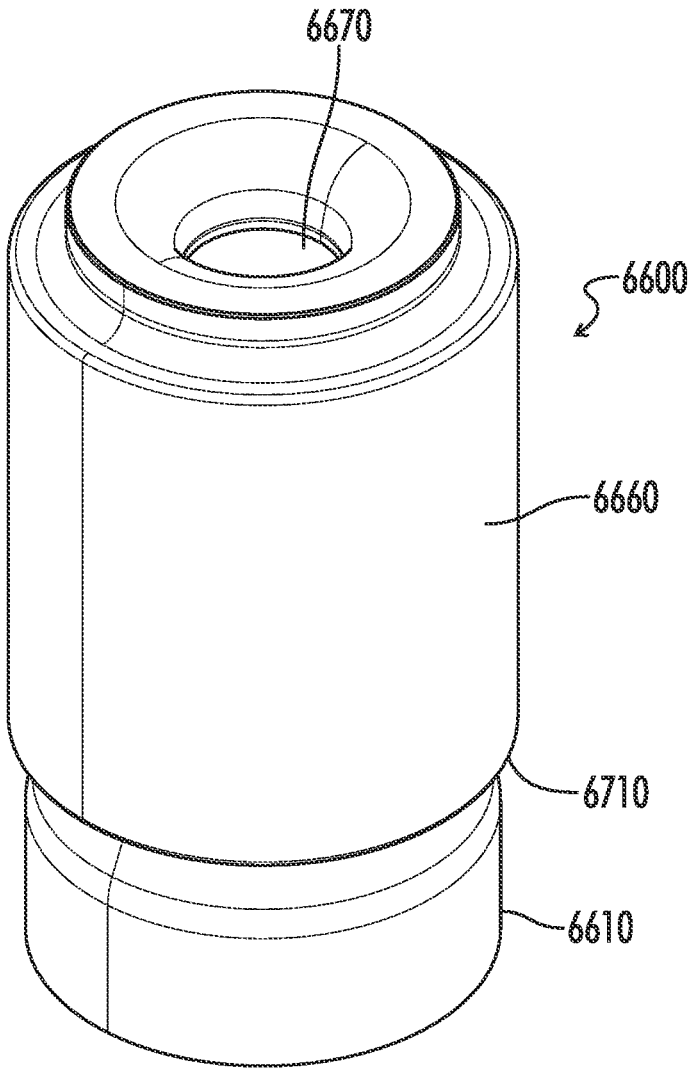
FIG. 3 shows the filter assembly of FIG. 1 with an outer housing removed.

FIG. 1 is a filter assembly 6600 in accordance with this disclosure. FIG. 2 is an inner filter housing 6610 for use in the filter assembly of FIG. 1. FIG. 3 shows the filter assembly 6600 of FIG. 1 with an outer housing 6620 removed.

Figure 4:
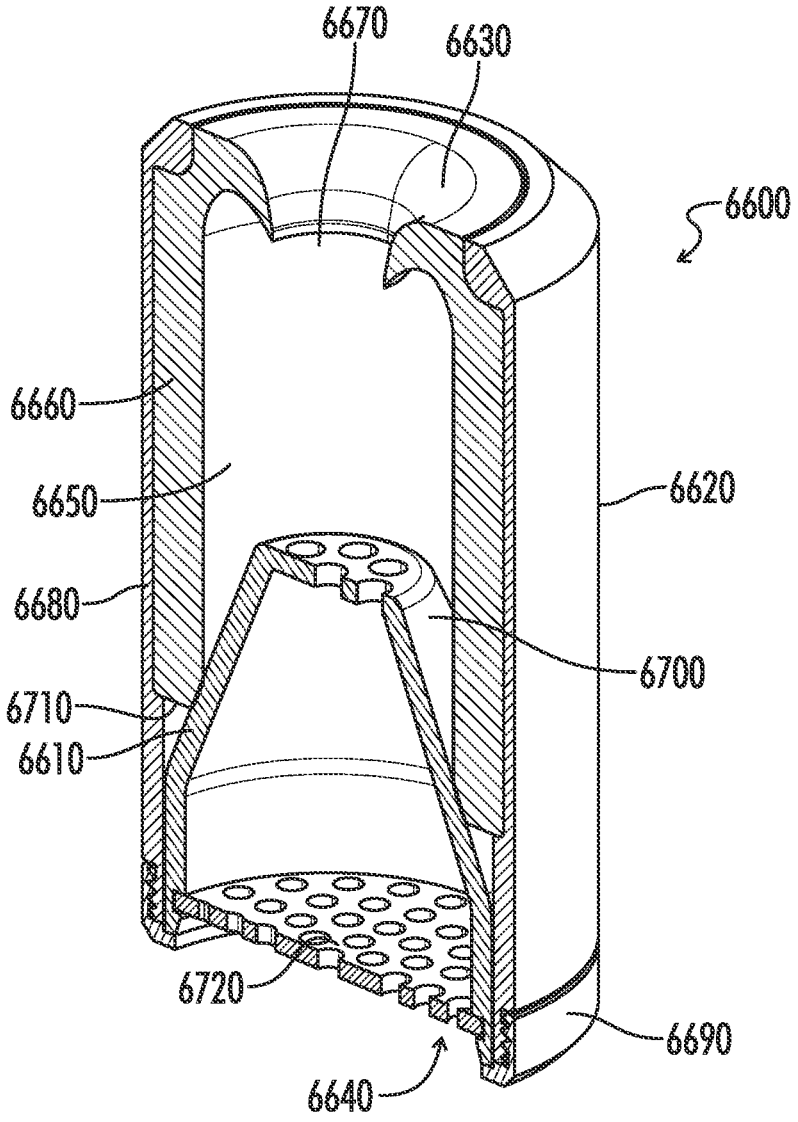
FIG. 4 shows a sectioned perspective view of the filter assembly of FIG. 1.
Figure 5:
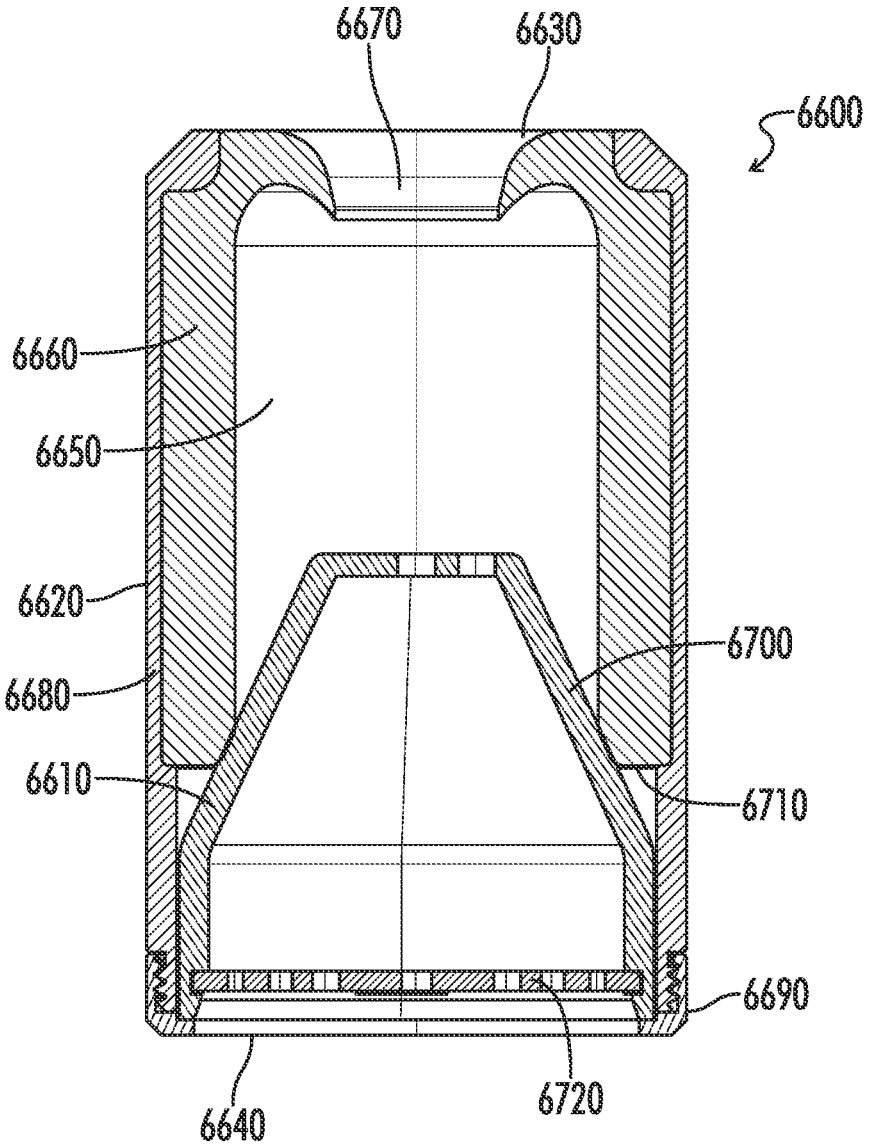
FIG. 5 shows a sectioned view of the filter assembly of FIG. 1.
Figure 6:
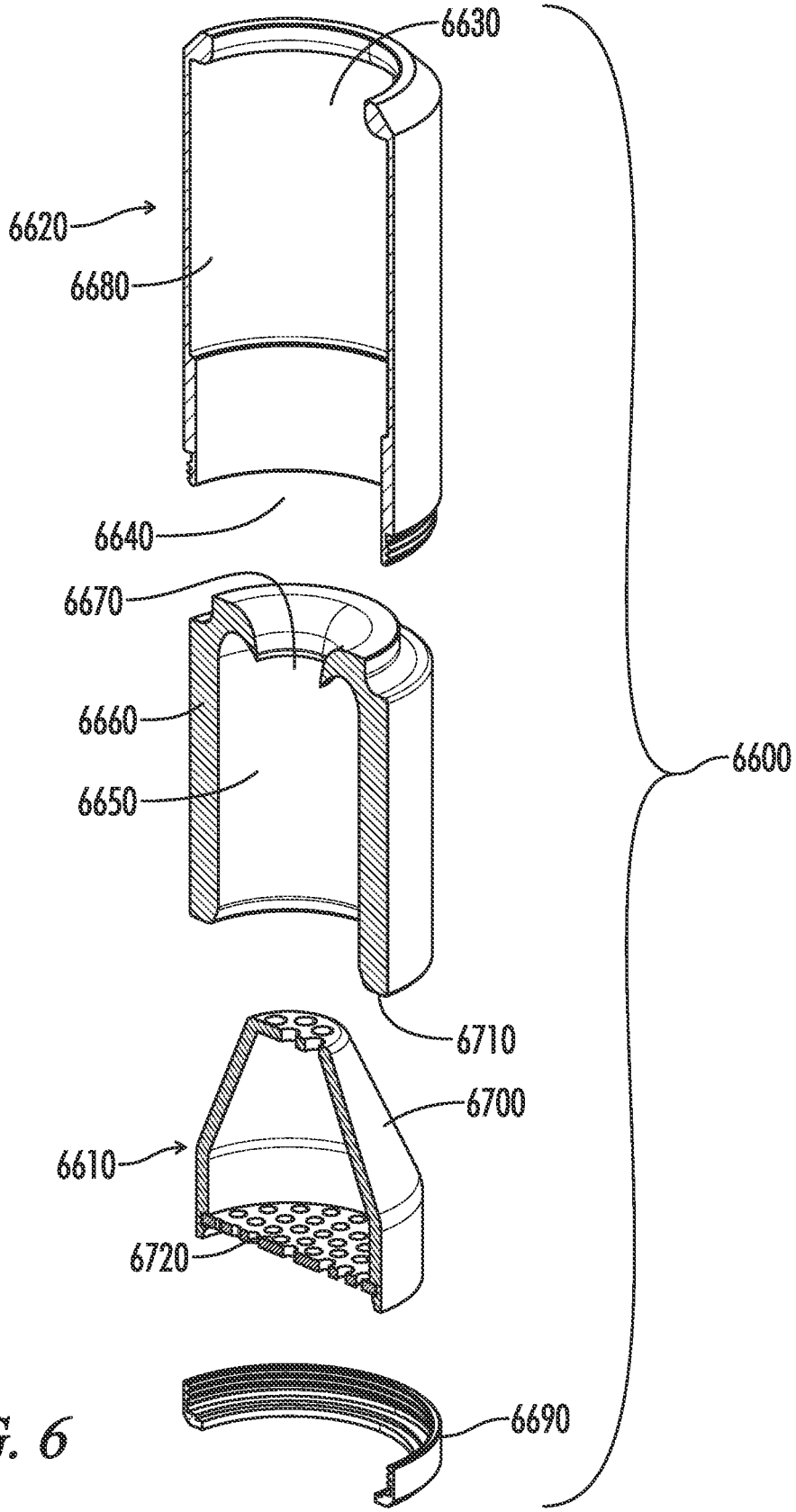
FIG. 6 shows a partially exploded view of the filter assembly of FIG. 1.

FIGS. 4 and 5 show sectioned perspective views of the filter assembly 6600 of FIG. 1. FIG. 6 shows a partially exploded view of the filter assembly 6600 of FIG. 1.

As shown, the filter assembly 6600 generally has an outer housing 6620 having an open first end 6630 and an open second end 6640. The filter assembly 6600 also has an inner filter housing 6610 within the outer housing 6620 and adjacent the second end 6640 of the outer housing.

Within the outer housing 6620, there is an internal chamber 6650 formed between the first end 6630 of the outer housing 6620 and the inner filter housing 6610.

During use, fluid within the internal chamber 6650 is drawn out the second end 6640 of the outer housing 6620 by way of the inner filter housing 6610. As discussed in more detail below, the inner filter housing 6610 typically contains filtering materials, such as a carbon filter, and therefore any fluid passing from the internal chamber 6650 to the second end 6640 of the housing 6620, thereby passing through the inner filter housing 6610, is filtered.

When using the filter assembly 6600, the filter assembly would typically be mounted to an end of a downstem of a hookah, as discussed below in reference to FIGS. 8A-8B. therefore, the filter assembly 6600 would likely be at least partially submerged in water or some other fluid in a base of a hookah. Accordingly, the fluid located within the internal chamber 6650, typically smoke, would pass through the inner filter housing 6610 and exit into the water in the base of the hookah, and would ultimately be inhaled by a user. When a user inhales the filtered smoke, such inhalation would draw additional smoke from the downstem into the internal chamber 6650 of the filter assembly 6600, which would then ultimately be filtered when the user continues to or resumes inhalation.

The filter assembly 6600 further has a gasket 6660 at the first end of the outer housing 6620. As shown, the gasket 6660 forms a gasketed opening 6670 smaller than the opening of the open first end 6630 at the first end of the outer housing 6620. The gasket 6660 extends axially adjacent a wall 6680 of the outer housing 6620 and ultimately abuts the inner filter housing 6610.

As shown, the outer housing 6620 may be substantially cylindrical, and the outer housing may then be internally lined by the gasket 6660. As such, the internal chamber 6650 may ultimately be defined by the gasket 6660 and the inner filter housing 6610, and the gasketed opening 6670 then provides access to the internal chamber.

As shown, the inner filter housing 6610 may be at least partially conical. For example, the inner filter housing 6610 may contain a conical surface 6700. In such a scenario, an axial end 6710 of the gasket 6660 may abut the conical surface 6700 of the inner filter housing 6610.

It will be understood that while the internal chamber 6650 is discussed and defined in terms of a gasket 6660, in some embodiments a different sealing feature may be provided to form the internal chamber 6650. For example, in embodiments where the inner filter housing 6610 is provided with a conical surface 6700, a corresponding conical surface may be provided on an interior wall of the outer housing 6620. In such an embodiment, a simpler gasket may be provided to seal the first end 6630 of the outer housing 6620 to a downstem on a hookah, or an alternative sealing mechanism may be provided at the first end as well.

The filter assembly 6600 may further have a fixation element 6690 for fixing to the second end 6640 of the outer housing 6620. In such a scenario, the fixation element 6690 may compress the inner filter housing 6610 against the gasket 6660. For example, the fixation element 6690 may be a cap designed to be screwed on to the second end 6640 of the outer housing 6620, and the second end may then be threaded to accept the fixation element. In such a scenario, the tightening of the threaded fixation element 6690 may slowly compress the conical surface 6700 of the inner filter housing 6620 against the gasket 6660.

As shown, an aerator 6720 may be provided at the second end 6640 of the outer housing 6620. Such an aerator 6720 may be integrated into the outer housing itself 6620, the fixation element 6690, or the inner filter housing 6610.

Figure 7:
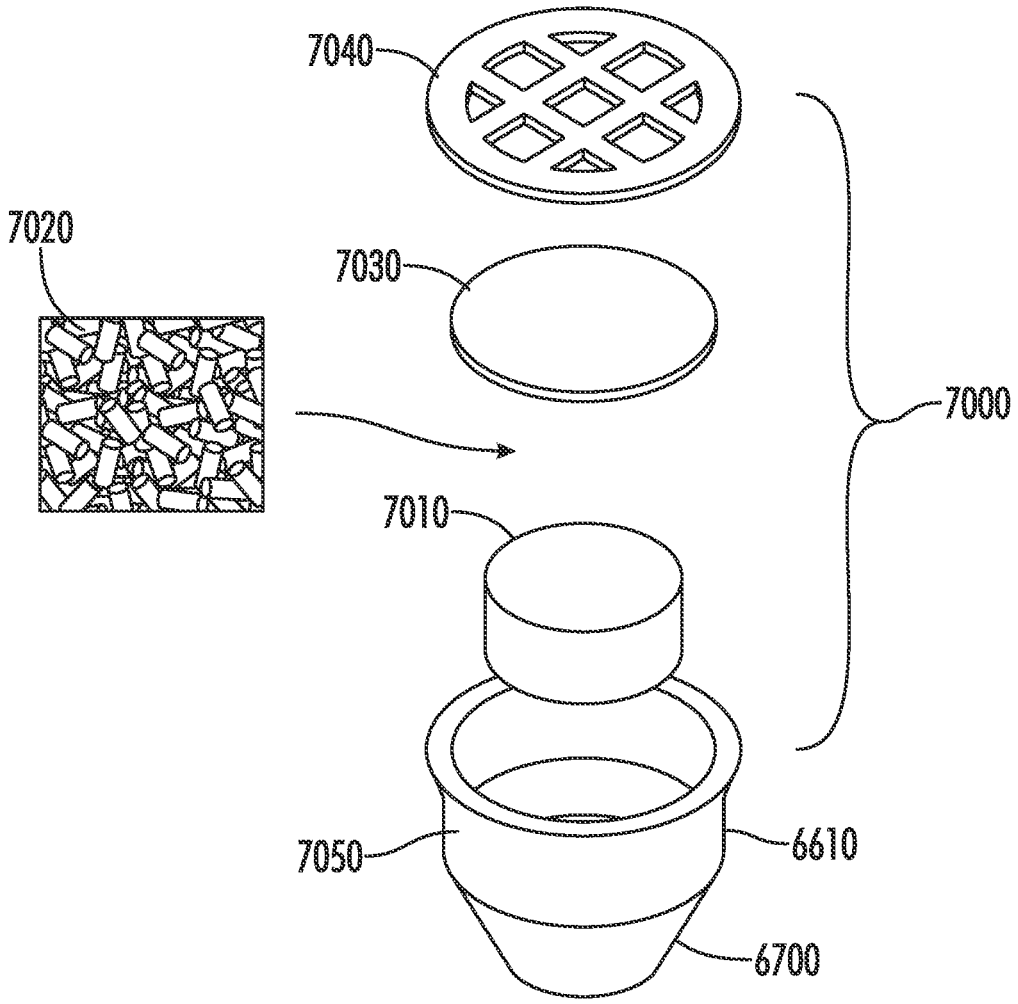
FIG. 7 shows an exploded view of one example of an inner filter housing with a filter in accordance with this disclosure.

FIG. 7 shows an exploded view of one example of an inner filter housing 6610 with a filter 7000 in accordance with this disclosure. As shown, the filter 7000 is typically a carbon filter, and it may include a carbon sponge 7010 located adjacent carbon pellets 7020 and a filter mesh 7030, with the carbon pellets typically sandwiched between the carbon sponge and the filter mesh. The filter mesh may be covered with a filter top 7040 which combines with a body 7050 of the inner filter housing 6610 to retain the various filter components. While carbon pellets 7020 are shown, the carbon pellets may similarly take the form of rods, squares, or any other shape carbon components. Similarly, while a carbon filter 7000 is shown and described, various alternative types of filters are contemplated as well.

Figure 8A:
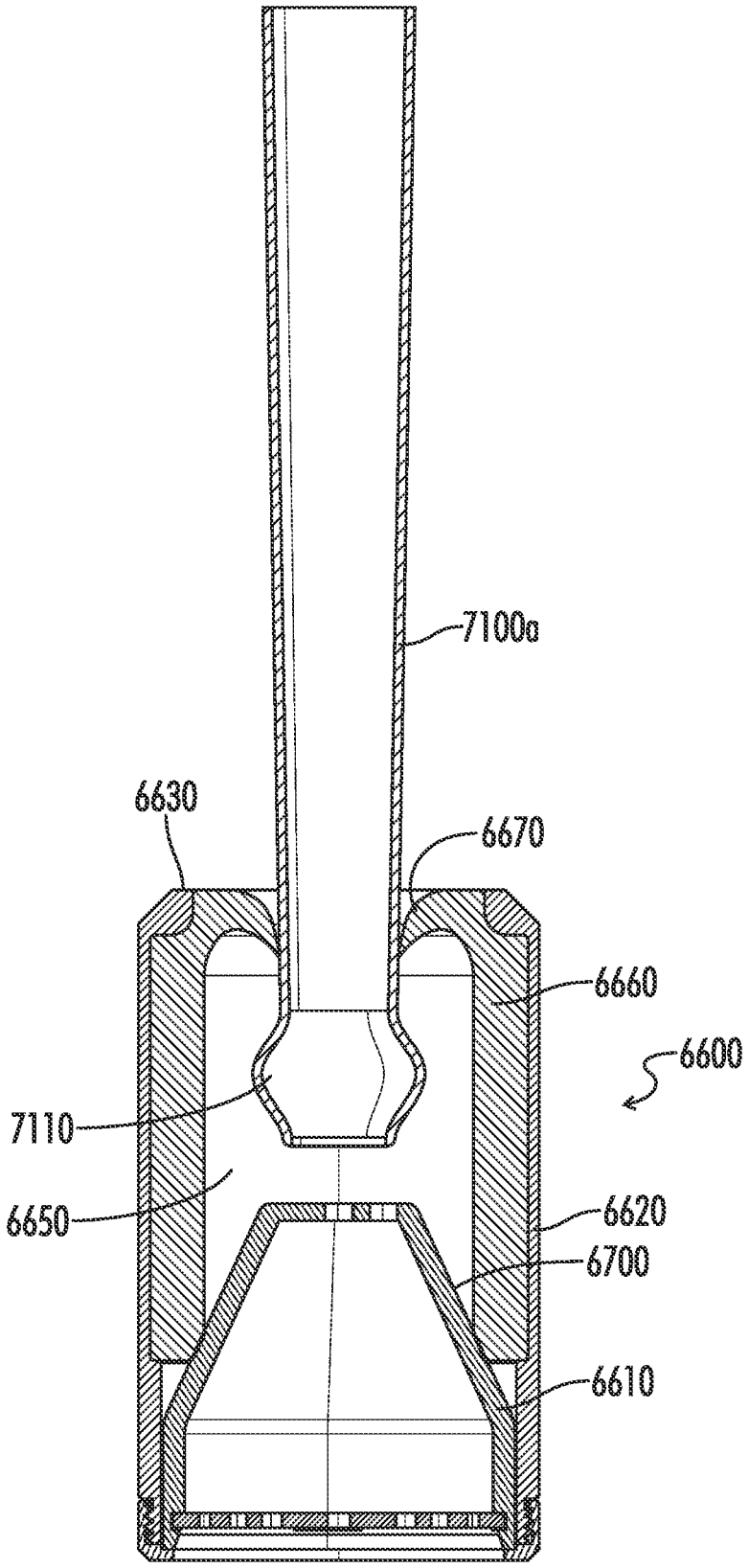
FIGS. 8A and 8B show the filter assembly of FIG. 1 in use on a hookah downstem.
Figure 8B:
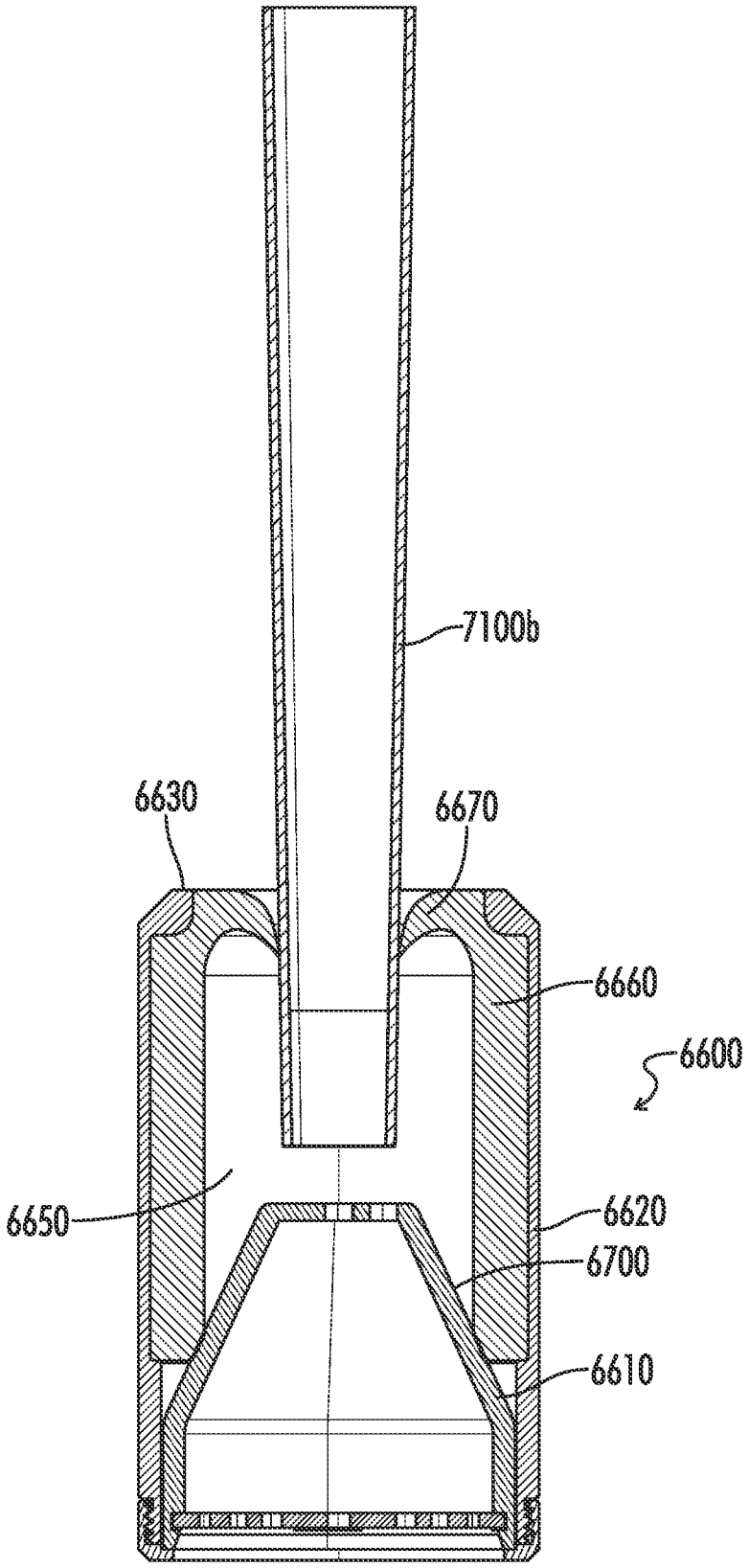

FIGS. 8A and 8B show the filter assembly 6600 of FIG. 1 in use on a hookah downstem 7100*a, b*. As shown, the gasketed opening 6670 of the gasket 6660 may be configured to seal against a shaft of a downstem 7100*a, b*. As such, any fluid, typically smoke, that is drawn through the downstem 7100*a, b* is drawn into the internal chamber 6650. Subsequently, any such smoke is drawn through the inner filter housing 6610 such that it passes through the filter 7000 contained therein.

As shown, and as discussed above, the gasketed opening 6670 is smaller than the opening of the first end 6630 of the outer housing 6620. The gasket 6660 is typically formed of a flexible material, such as silicon. When the filter assembly 6600 is applied to a downstem 7100*a, b*, the gasketed opening 6670 typically stretches to accept the downstem.

As shown in FIG. 8A, some downstems 7100*a* may have segments 7110 having a radius larger than a shaft 7120 of the same downstem. In such embodiments, the outer housing 6600 and the gasketed opening 6670 may be sized such that the gasketed opening 6670 is smaller than a radius of the larger radius segment 7110 and the open first end 6630 of the outer housing is larger than the corresponding radius, such that the segment 7110 can be located within the internal chamber 6650.

Figure 9:
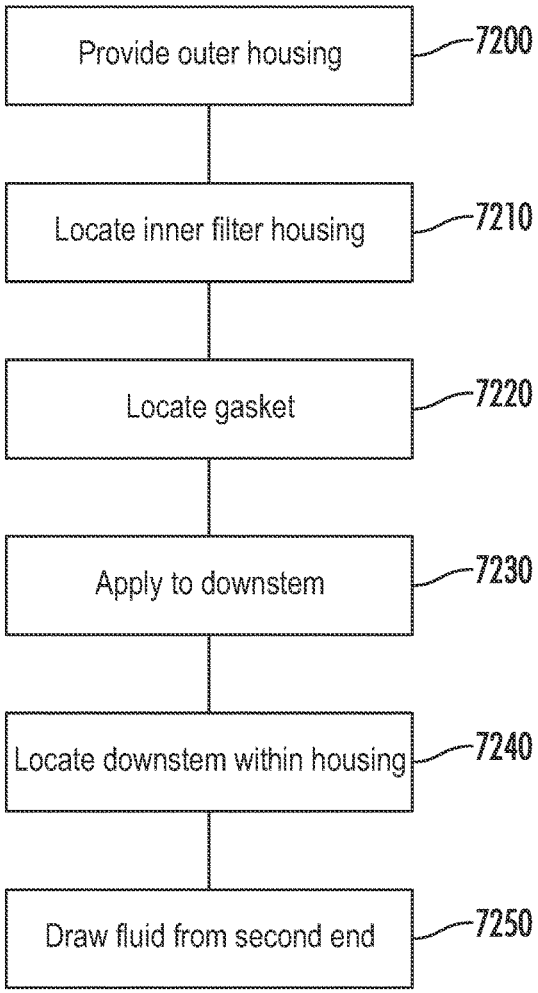
FIG. 9 is a flowchart illustrating a method for filtering fluid in a hookah using a filter assembly.

FIG. 9 is a flowchart illustrating a method for filtering fluid in a hookah using a filter assembly. As shown, a method is provided in which an outer housing 6620 of a filter assembly 6600 having an open first end 6630 and an open second end 6640 is provided (at 7200) and an inner filter housing 6610 is located within the outer housing 6620 (at 7210) adjacent an open second end 6640 of the outer housing. By locating the inner filter housing 6610 adjacent the open second end, an internal chamber 6650 is formed between the first end 6630 of the outer housing 6620 and the inner filter housing.

A gasket 6660 is then located (at 7220) within the outer housing 6620 adjacent the second end 6640 such that the gasket forms a gasketed opening 6670 smaller than the open first end 6630 of the outer housing 6620.

The filter assembly 6600 is then slid (at 7230) onto an end of a hookah downstem 7100*a, b* to form a fluid tight connection between the gasket 6660 and the downstem, and the end of the hookah downstem is located (7240) within the outer housing 6620 of the filter assembly 6600.

Once the end of the downstem 7100*a, b* is positioned within the interior chamber 6650 of the filter assembly 6600, the assembled hookah is used. Once smokable materials begin to smoke, a user draws fluid from a base of the hookah into which the downstem 7100*a, b* extends. As such, the user draws fluid (at 7250), which is typically smoke, from the second end 6640 of the outer housing 6620 of the filter assembly 6600 which in turn draws fluid from the interior chamber 6650 through the inner filter housing 6610 and further draws fluid from the downstem 7100*a, b* into the interior chamber 6650.

Typically, a user would draw fluid from the second end 6640 of the outer housing 6620 indirectly by, for example, drawing fluid from a hose connected fluidically to a chamber in which the second end is located. Such a connection may be, for example, by way of a secondary smoke chamber which is itself connected fluidically to the chamber in which the second end is located.

In this way, when the hookah is in use, smoke drawn from the smokable materials first passes through the downstem and through the filter and then passes through the fluid in the base prior to being inhaled by the user.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A filter assembly comprising:

an outer housing having an open first end and an open second end;

an inner filter housing within the outer housing adjacent the second end;

a carbon filter within the inner filter housing, wherein fluid passing through the inner filter housing is filtered by the filter;

a gasket at the first end of the outer housing; and an internal chamber between the first end of the outer housing and the inner filter housing, wherein, during use, fluid within the internal chamber is drawn out the second end of the outer housing by way of the inner filter housing.

2. The filter assembly of claim 1, wherein the carbon filter comprises a carbon sponge located adjacent carbon pellets, such that fluid filtered by the filter passes through the carbon sponge and the carbon pellets consecutively.

3. A filter assembly comprising:

an outer housing having an open first end and an open second end;

an inner filter housing within the outer housing adjacent the second end;

a gasket at the first end of the outer housing; and an internal chamber between the first end of the outer housing and in the inner filter housing, wherein, during use, fluid within the internal chamber is drawn out of the second end of the outer housing by way of the inner filter housing, and wherein the gasket forms a gasketed opening smaller than the open first end at the open first end of the outer housing.

4. The filter assembly of claim 3, wherein the gasket extends axially adjacent a wall of the outer housing and abuts the inner filter housing, such that the internal chamber is defined by the gasket and the inner filter housing.

5. The filter assembly of claim 4, wherein the outer housing is substantially cylindrical and wherein the outer housing is internally lined by the gasket.

6. The filter assembly of claim 4 further comprising a fixation element for fixing to the second end of the outer housing, wherein the fixation element compresses the inner filter housing against the gasket.

7. The filter assembly of claim 4, wherein the inner filter housing is at least partially conical, such that an axial end of the gasket abuts a conical surface of the inner filter housing.

8. A filter assembly comprising:

an outer housing having an open first end and an open second end;

an inner filter housing within the outer housing adjacent the second end;

a gasket at the first end of the outer housing; and an internal chamber between the first end of the outer housing and in the inner filter housing, wherein, during use, fluid within the internal chamber is drawn out of the second end of the outer housing by way of the inner filter housing, and wherein, during use, the internal chamber encloses an end of a hookah downstem such that fluid drawn from the downstem is drawn through the inner filter housing.

9. A filter assembly comprising:

an outer housing having an open first end and an open second end;

an inner filter housing within the outer housing adjacent the second end;

a gasket at the first end of the outer housing;

an aerator at the second end of the outer housing; and an internal chamber between the first end of the outer housing and in the inner filter housing, wherein, during use, fluid within the internal chamber is drawn out of the second end of the outer housing by way of the inner filter housing.

10. A method for filtering fluid in a hookah, the method comprising:

providing an outer housing having an open first end and an open second end locating an inner filter housing within the outer housing adjacent the second end, such that an internal chamber is formed between the first end of the outer housing and the inner filter housing;

locating a gasket at the open first end, such that the gasket forms a gasketed opening smaller than the open first end of the outer housing;

sliding the gasketed opening onto an end of a hookah downstem to form a fluid tight connection between the gasket and the downstem;

locating the end of the hookah downstem within the outer housing; and drawing fluid from the second end of the outer housing, such that fluid drawn from the second end of the outer housing is received from the downstem by way of the inner filter housing.

11. The method of claim 10 further comprising providing a filter within the inner filter housing, such that fluid passing through the inner filter housing is filtered by the filter.

12. The method of claim 11, wherein the filter is a carbon filter.

13. The method of claim 12, wherein the carbon filter comprises a carbon sponge located adjacent carbon pellets, such that fluid filtered by the filter passes through the carbon sponge and the carbon pellets consecutively.

14. The method of claim 10, wherein the gasket extends axially adjacent a wall of the outer housing and abuts the inner filter housing, such that the internal chamber is defined by the gasket and the inner filter housing.

15. The method of claim 14, wherein the outer housing is substantially cylindrical and wherein the outer housing is internally lined by the gasket.

16. The method of claim 14, further comprising applying a fixation element at the second end of the outer housing such that the fixation element compresses the inner filter housing against the gasket.

* * * * *